US008820897B2

(12) United States Patent
Furuya et al.

(10) Patent No.: US 8,820,897 B2
(45) Date of Patent: Sep. 2, 2014

(54) LIQUID DROPLET EJECTING HEAD, METHOD FOR MANUFACTURING THE SAME, AND LIQUID DROPLET EJECTING APPARATUS

(75) Inventors: Noboru Furuya, Chino (JP); Atsushi Takakuwa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 505 days.

(21) Appl. No.: 12/943,557

(22) Filed: Nov. 10, 2010

(65) Prior Publication Data

US 2011/0109704 A1 May 12, 2011

(30) Foreign Application Priority Data

Nov. 11, 2009 (JP) ..... 2009-257816

(51) Int. Cl.

| | |
|---|---|
| ***B41J 2/045*** | (2006.01) |
| ***B41J 2/16*** | (2006.01) |
| ***B41J 2/055*** | (2006.01) |
| *B41J 2/14* | (2006.01) |

(52) U.S. Cl.

CPC ..... *B41J 2/055* (2013.01); *B41J 2002/14241* (2013.01); *B41J 2/161* (2013.01); *B41J 2/1626* (2013.01); *B41J 2002/14419* (2013.01); *B41J 2/1625* (2013.01); *B41J 2/1646* (2013.01); *B41J 2/1623* (2013.01); *B41J 2/14233* (2013.01)

USPC ..... 347/71; 347/70

(58) Field of Classification Search

USPC ..... 347/71

See application file for complete search history.

(56) References Cited

U.S. PATENT DOCUMENTS

2006/0234159 A1 10/2006 Yamaguchi

FOREIGN PATENT DOCUMENTS

| | | | | |
|---|---|---|---|---|
| JP | 2000-117974 | | 4/2000 | |
| JP | 2006-321984 | | 11/2006 | |
| JP | 2007-176030 | | 7/2007 | |
| JP | 2007176030 | * | 7/2007 | ..... B41J 2/16 |
| JP | 2009-046569 | | 3/2009 | |

* cited by examiner

*Primary Examiner* — Uyen Chau N Le
*Assistant Examiner* — Kajli Prince
(74) *Attorney, Agent, or Firm* — Workman Nydegger

(57) ABSTRACT

A liquid droplet ejecting head includes a fluid path forming substrate having a fluid path communicating with nozzle holes and a diaphragm on the fluid path forming substrate. The diaphragm has a first surface facing a second surface. A piezoelectric element on the first surface of the diaphragm has a piezoelectric body layer interposed between a first electrode and a second electrode. A support substrate on the first surface of the diaphragm has a space for containing the piezoelectric element. The support substrate includes a first member formed on the first surface of the diaphragm, and a second member formed on the first member. The first member has a first opening for containing the piezoelectric element. The space of the support substrate is defined by the first opening of the first member and the second member. The main material of the first member is resin.

8 Claims, 13 Drawing Sheets

LIQUID DROPLET EJECTING HEAD, METHOD FOR MANUFACTURING THE SAME, AND LIQUID DROPLET EJECTING APPARATUS

This application claims a priority to Japanese Patent Application No. 2009-257816 filed on Nov. 11, 2009 which is hereby expressly incorporated by reference herein in its entirety.

BACKGROUND

1. Technical Field

The present invention relates to a liquid droplet ejecting head, a method for manufacturing the same, and a liquid droplet ejecting apparatus.

2. Related Art

For example, in a liquid droplet ejecting apparatus such as an ink jet printer which is available for an image recording apparatus, a display manufacturing apparatus and the like, a piezoelectric element has been extensively used for a liquid droplet ejecting head for ejecting liquid droplets such as ink. In relation to such a piezoelectric element, for example, a piezoelectric body is deformed by the voltage of a driving signal and the like applied thereto, so that a diaphragm formed under the piezoelectric element is deformed, resulting in a change in the volume of a pressure chamber. Thus, the liquid droplet ejecting head may eject liquid droplets such as ink which is supplied to the pressure chamber through nozzle holes.

In a member constituting such a liquid droplet ejecting head, for example, a support substrate including a silicon substrate and the like has been well known as a member for protecting the piezoelectric element (refer to JP-A-2007-176030).

When such a support substrate is formed and glued to a substrate having the piezoelectric element, for example, a manufacturing method shown in FIG. 13 has been well known. First, for example, a hard mask layer is formed on a silicon substrate through a sputtering method and the like (S111). Next, an exposure/development process is performed using a photolithography technology, so that a resist layer with a desired pattern is formed (S112 and S113). Then, the hard mask layer is etched using the resist layer so as to have a desired shape (S114). Thereafter, an unnecessary resist layer is removed (S115). Further, for example, by the use of an etching technology such as wet etching using the hard mask layer, an area serving as a space for protecting the piezoelectric element, a through hole for an ink supply fluid path, and the like are formed in the silicon substrate, so that a support substrate is formed (S116). Next, an adhesion process using adhesive is performed in order to glu the support substrate to the substrate having the piezoelectric element (S117 and S118). For example, the adhesive is transferred and coated on an adhesive portion of the support substrate (S117) and the substrate having the piezoelectric element is glued to the support substrate, so that the piezoelectric element is protected by the support substrate (S118 and S120).

In the case of using the adhesive in order to glue the support substrate to the substrate having the piezoelectric element, since the adhesive has viscosity, the adhesive may not easily be coated with a certain thickness or less and has fluidity. Therefore, it is probable that the adhesive may flow into an ink supply path formed in a fluid path forming plate at the time of the gluing process and the ink path may not be sufficiently ensured. Further, in the case of using the adhesive having fluidity, it is probable that liquid dripping and the like may occur in the transfer process of the adhesive, thereby causing the reduction in the yield in the manufacturing process.

SUMMARY

An advantage of some aspects of the invention is to provide a liquid droplet ejecting head with high reliability.

An advantage of some aspects of the invention is to provide a liquid droplet ejecting head manufactured by a simple process with high productivity.

An advantage of some aspects of the invention is to provide a simple manufacturing method with high productivity of a liquid droplet ejecting head.

An advantage of some aspects of the invention is to provide a liquid droplet ejecting apparatus including the liquid droplet ejecting head.

According to one aspect of the invention, there is provided a liquid droplet ejecting head including: a fluid path forming substrate having a fluid path communicating with nozzle holes; a diaphragm formed on the fluid path forming substrate and having a first surface and a second surface facing the first surface; a piezoelectric element formed on the first surface of the diaphragm and having a piezoelectric body layer interposed between a first electrode and a second electrode; and a support substrate formed on the first surface of the diaphragm and having a space for containing the piezoelectric element, wherein the support substrate includes: a first member formed on the first surface of the diaphragm; and a second member formed on the first member, wherein the first member is formed with a first opening in which the piezoelectric element is contained, the space of the support substrate is defined by the first opening of the first member and the second member, and the main material of the first member is resin.

In addition, in the description according to the invention, the expression "being on", for example, represents that "a specific matter (hereinafter, referred to as "A") is formed "on" another specific matter (hereinafter, referred to as "B")". In the description according to the invention, in such an example, the expression "being on" includes the case in which B is directly formed on A and the case in which B is formed on A through another matter. Similarly to this, the expression "being under" includes the case in which B is directly formed under A and the case in which B is formed under A through another matter.

According to one aspect of the invention, it may be possible to provide a liquid droplet ejecting head in which no adhesive exists between the support substrate and the diaphragm serving as the substrate on which a piezoelectric element is formed. Thus, since no adhesive is used at the time of a process of gluing the support substrate to the diaphragm, an adhesive having fluidity is prevented from being introduced into an ink path, an area where the piezoelectric element is formed, and the like. Consequently, it may be possible to provide a liquid droplet ejecting head with high reliability.

Furthermore, according to the invention, an etching process of the support substrate may be simplified and an adhesive transfer process of gluing the support substrate to the diaphragm may be omitted. Consequently, it may be possible to provide a liquid droplet ejecting head manufactured by a simple process with high productivity.

According to one aspect of the invention, the resin serving as the material of the first member may be formed from a photosensitive adhesive composite.

According to one aspect of the invention, the material of the second member may include at least one of single crystalline silicon, glass, nickel, stainless steel and stainless.

According to one aspect of the invention, the second member may be formed with a second opening which communicates with the first opening of the first member, and may have an area smaller than an area of the first opening.

According to one aspect of the invention, a liquid droplet ejecting apparatus may include any one of the above-described liquid droplet ejecting heads.

According to another aspect of the invention, it may be possible to provide a method for manufacturing a liquid droplet ejecting head, including: forming a second member from a first substrate having a first surface and a second surface facing the first surface; gluing a photosensitive adhesive film to the second member; forming a first member formed with a first opening by patterning the photosensitive adhesive film, and forming a support substrate having a space defined by the first surface of the second member and the first opening of the first member; forming a piezoelectric element on a first surface of a second substrate having the first surface and a second surface facing the first surface, the piezoelectric element having a piezoelectric body layer interposed between a first electrode and a second electrode; and gluing the support substrate to the first surface of the second substrate such that the piezoelectric element is contained in the space.

According to the invention, an etching process of the support substrate may be simplified and an adhesive transfer process of gluing the support substrate to the diaphragm may be omitted. Consequently, it may be possible to provide a liquid droplet ejecting head manufactured by a simple process with high productivity.

According to another aspect of the invention, the support substrate may be glued to the second substrate by the adhesive properties of the first member.

According to another aspect of the invention, the gluing of the support substrate may further include applying a heat treatment process to the first member to produce the adhesive properties.

According to another aspect of the invention, the heat treatment process may be performed at a temperature range of 150° C. to 200° C.

According to another aspect of the invention, the forming of the second member may include forming a second opening having an area smaller than an area of the first opening, and the forming of the first member may further include patterning the first opening such that the first opening communicates with the second opening.

According to another aspect of the invention, the photosensitive adhesive film may have a thickness larger than the height from the first surface of the second substrate of the piezoelectric element.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment of the present invention will be described with reference to the accompanying drawings. However, the invention is not limited to the following embodiment. The invention includes arbitrary combinations of the following embodiment and modified examples thereof.

1. Liquid Droplet Ejecting Head

Hereinafter, the liquid droplet ejecting head in accordance with the present embodiment will be described with reference to the accompanying drawings.

Figure 1:
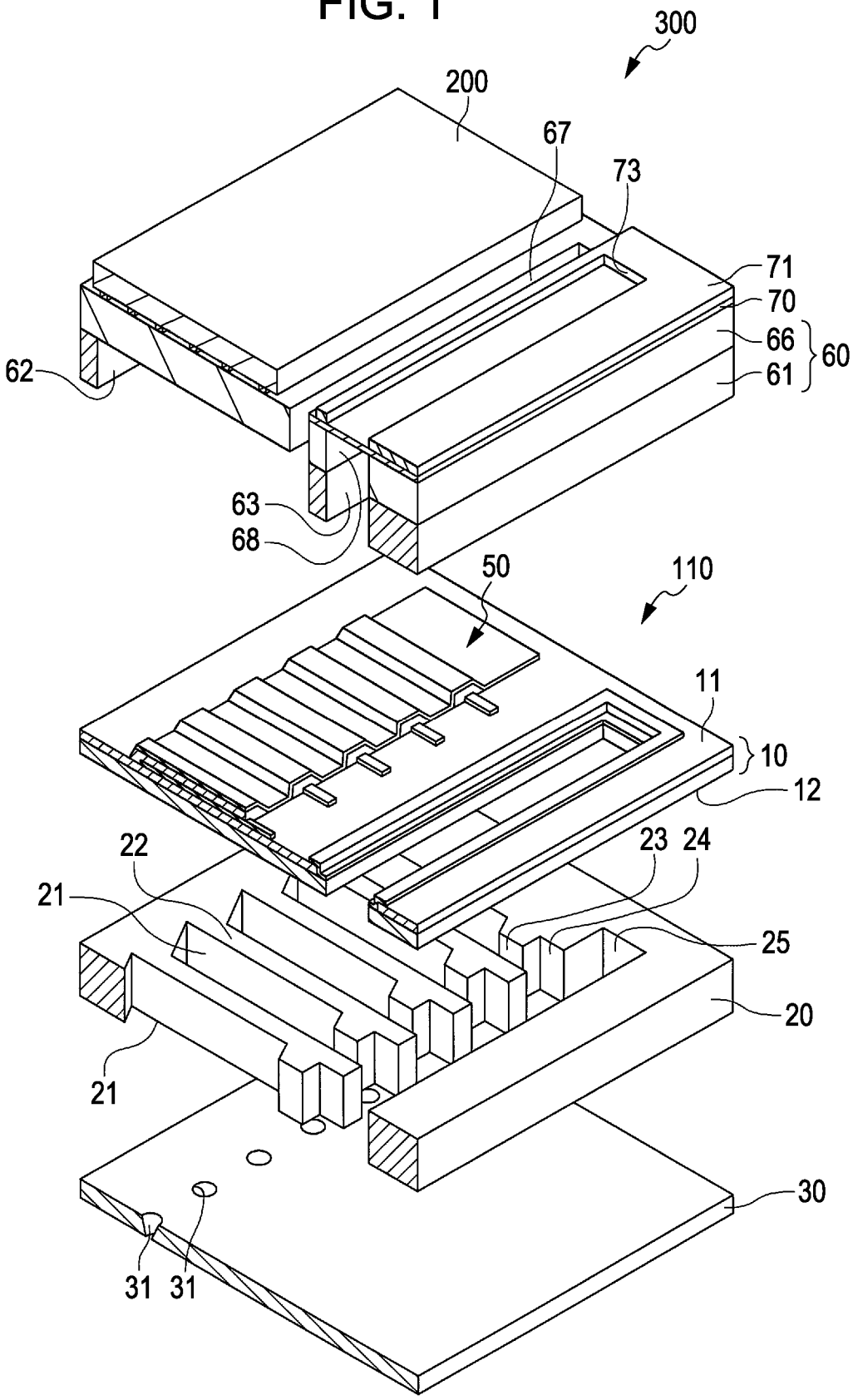
FIG. 1 is an exploded perspective view schematically showing a liquid droplet ejecting head in accordance with an embodiment.
Figure 2:
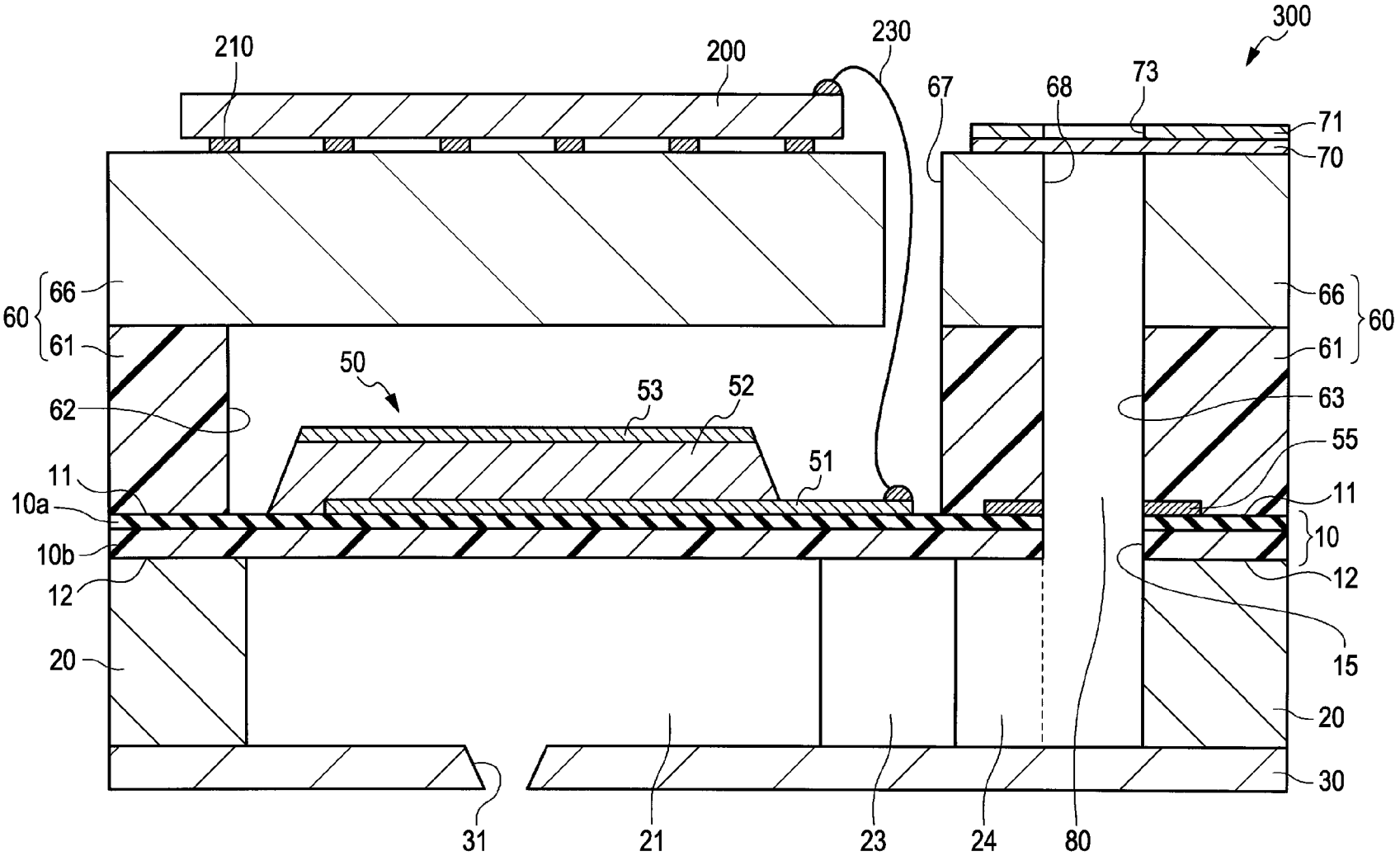
FIG. 2 is a sectional view schematically showing main elements of a liquid droplet ejecting head in accordance with an embodiment.
Figure 3A:
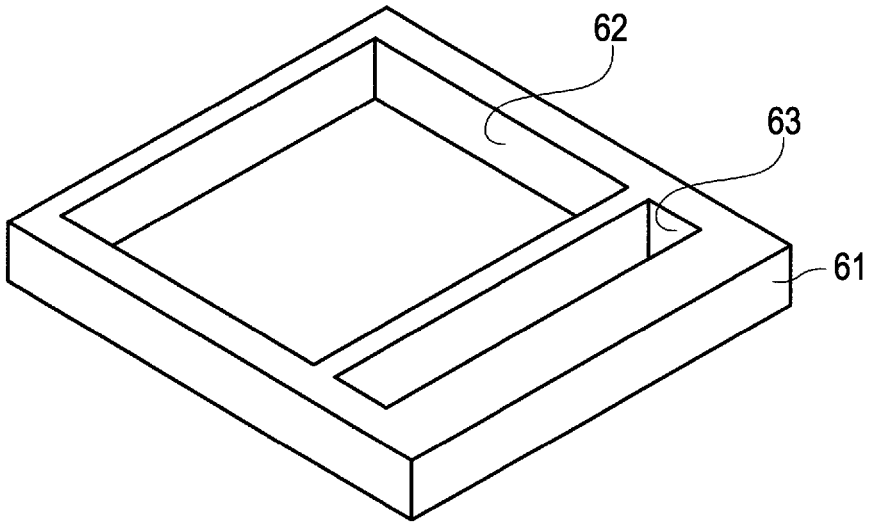
FIGS. 3A and 3B are exploded perspective views schematically showing a liquid droplet ejecting head in accordance with an embodiment.
Figure 3B:
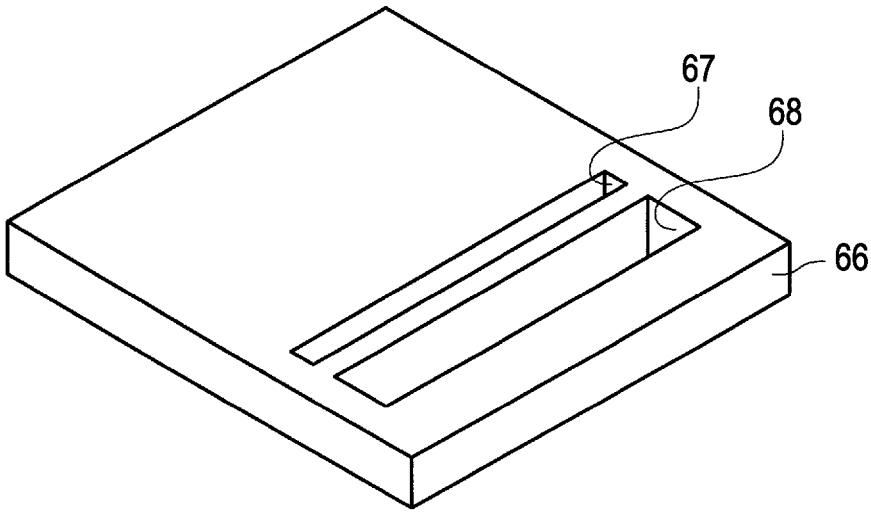

FIG. 1 is an exploded perspective view schematically showing the liquid droplet ejecting head 300 in accordance with the embodiment. FIG. 2 is a sectional view schematically showing main elements of the liquid droplet ejecting head 300 in accordance with the embodiment. FIGS. 3A and 3B are exploded perspective views schematically showing a support substrate 60 of the liquid droplet ejecting head 300 in accordance with the embodiment.

As shown in FIGS. 1 and 2, in the liquid droplet ejecting head 300 in accordance with the embodiment, a piezoelectric element 50 includes a diaphragm 10 formed on a first surface 11, a fluid path forming plate 20 formed on a second surface 12 of the diaphragm 10, a nozzle plate 30 formed under the fluid path forming plate 20, and a support substrate 60 provided above the diaphragm 10 (the first surface 11) to protect the piezoelectric element 50.

Hereinafter, after a description of the piezoelectric element 50 and a substrate having the piezoelectric element 50 is given, the support substrate 60 that protects the piezoelectric element will be described.

As shown in FIGS. 1 and 2, the diaphragm 10 is a member with a plate shape and has the first surface 11 on which the piezoelectric element 50 is formed, and the second surface 12 facing the first surface 11. In the liquid droplet ejecting head 300, the diaphragm 10 constitutes a deformation unit. In other words, due to the deformation of the piezoelectric element 50 which will be described later, the diaphragm 10 may be deformed. Therefore, the volume of a pressure chamber 21 of the fluid path forming plate 20 formed under the diaphragm 10 may be changed. The structure and the material of the diaphragm 10 are not specifically limited as long as the diaphragm 10 can be flexible and can be deformed. For example, as shown in FIG. 2, the diaphragm 10 may be formed of a stack member of a plurality of films. At this time, the diaphragm 10, for example, may be a stack member including an elastic film 10*a* and an insulation film 10*b*. The elastic film 10*a* includes a polymer material such as silicon oxide and polyimide, and the like. The insulation film 10*b* includes Zirconium oxide, Yttria-stabilized zirconia (YSZ) and the like.

Further, as shown in FIG. 2, the diaphragm 10 is formed with an opening 15 that communicates with a reservoir 25 which will be described later. The shape of the opening 15 is not specifically limited as long as liquid can be supplied to the reservoir 25 of the fluid path forming plate 20 which will be described later. Furthermore, a conductive layer 55 including nickel and gold may also be formed around the opening 15.

As shown in FIGS. 1 and 2, the fluid path forming plate 20 is formed on the second surface 12 of the diaphragm 10. In other words, as shown in FIGS. 1 and 2, the fluid path forming plate 20 is arranged under the diaphragm 10 while facing the second surface 12. As shown in FIG. 1, the fluid path forming plate 20 has the pressure chamber 21. The upper surface and the lower surface of the pressure chamber 21 are defined by the second surface 12 of the diaphragm 10 and the nozzle plate 30 which will be described later, respectively. As shown in FIG. 1, the fluid path forming plate 20 has a wall portion 22 constituting the sidewall of the pressure chamber 21. Further, the fluid path forming plate 20 may have the reservoir 25 which communicates with the pressure chamber 21 through a supply path 23 and a communication path 24. The reservoir 25 communicates with the opening 15, and liquid may be supplied to the reservoir 25 from an outside through the opening 15. With such configuration, the liquid is supplied to the reservoir 25, so that the liquid can be supplied to the pressure chamber 21 through the supply path 23 and the communication path 24. In other words, the fluid path forming plate 20 has a fluid path including the pressure chamber 21, the supply path 23, the communication path 24 and the reservoir 25. Further, the respective shapes of the pressure chamber 21, the supply path 23, the communication path 24 and the reservoir 25 are not specifically limited as long as liquid matter such as ink can flow therethrough. For example, in a plan view seen from the direction perpendicular to the first surface 11 (hereinafter, also called a "plan view"), the shape of the pressure chamber 21 may be a parallelogram or rectangle. The number of the pressure chambers 21, the number of the supply paths 23 and the number of the communication paths 24 are not specifically limited. For example, the pressure chamber 21, the supply path 23 and the communication path 24 may be provided in a single number or plural number, respectively. The material of the fluid path forming plate 20 is not specifically limited. For example, the fluid path forming plate 20 may be made of single crystalline silicon, nickel, stainless, stainless steel, glass ceramic and the like.

As shown in FIGS. 1 and 2, the nozzle plate 30 is formed under (at an opposite side of the diaphragm 10) the fluid path forming plate 20. The nozzle plate 30 is a member with a plate shape and has nozzle holes 31. The nozzle holes 31 are formed to communicate with the pressure chamber 21. The shape of the nozzle hole 31 is not specifically limited as long as liquid can be discharged therethrough. For example, the liquid in the pressure chamber 21 can be discharged downward (toward the outside the nozzle holes 31 from the pressure chamber 21) from the nozzle plate 30 through the nozzle holes 31. The number of the nozzle holes 31 is not specifically limited. For example, one nozzle hole 31 may be provided. Furthermore, as shown in FIG. 1, a plurality of nozzle holes 31 may be provided to correspond to a plurality of pressure chambers 21, respectively. The material of the nozzle plate 30 is not specifically limited. For example, the nozzle plate 30 may be made of single crystalline silicon, nickel, stainless, stainless steel, glass ceramic and the like.

As shown in FIGS. 1 and 2, the piezoelectric element 50 is formed at the side of the first surface 11 of the diaphragm 10, that is, the piezoelectric element 50 is formed on the diaphragm 10. The piezoelectric element 50 may include a piezoelectric body layer 52 interposed between a first electrode 51 and a second electrode 53. For example, the piezoelectric element 50 may have a structure in which a predetermined voltage is applied to the piezoelectric body layer 52 through the first electrode 51 and the second electrode 53, so that the piezoelectric body layer 52 can be deformed. In detail, as shown in FIG. 2, the piezoelectric element 50 may include the first electrode 51 formed on the first surface 11 of the diaphragm 10 while extending in a predetermined direction, the piezoelectric body layer 52 covering at least a part of the first electrode 51, and the second electrode 53 covering at least a part of the piezoelectric body layer 52 while overlapping the first electrode 51 and the piezoelectric body layer 52. That is, the piezoelectric element 50 may include a unimorph-type piezoelectric element in a bending vibration mode (bending mode). Further, although not shown in FIGS. 1 and 2, the piezoelectric element 50 may also include a stacked piezoelectric element in a stretching vibration mode (piston mode).

Hereinafter, the case in which the piezoelectric element 50 is the unimorph-type piezoelectric element in the bending vibration mode (bending mode) and upper electrodes of a plurality of piezoelectric elements serve as common electrodes will be described as an example. However, the piezoelectric element 50 in accordance with the embodiment is not limited to the following configuration.

As shown in FIGS. 1 and 2, the first electrode 51 extends in the predetermined direction. As shown in FIG. 2, at least a part of the first electrode 51 may be arranged above the pressure chamber 21 to overlap the piezoelectric body layer 51 and the second electrode 53. However, the first electrode 51 is not specifically limited.

The first electrode 51 includes a layer having conductivity, and for example, may serve as a lower electrode of the piezoelectric element 50. The structure and material of the first electrode 51 are not specifically limited as long as the first electrode 51 has conductivity. For example, the first electrode 51 may be formed of a single layer. Furthermore, the first electrode 51 may also be formed of a stack member of a plurality of films. For example, the first electrode 51 may be a conductive layer including any one of platinum (Pt), iridium (Ir), gold (Au), nickel (Ni), titan (Ti) and conductive oxide such as strontium oxide (SRO) and lanthanum nickel oxide (LNO), and the like.

Furthermore, the first electrode 51 may have a lead portion serving as a contact portion of a driving circuit (IC) 200. The lead portion may be made of metal similarly to the first electrode 51. Although not shown in FIGS. 1 and 2, the lead portion may be formed of a metal layer including a stack member having nickel-chrome alloy (NiCr), gold (Au) and the like. Moreover, although not shown in FIGS. 1 and 2, the piezoelectric body layer 52 may be formed with a contact hole through which the first electrode 51 is exposed, and a lead wiring serving as the lead portion of the first electrode 51 may be formed in the contact hole.

As shown in FIG. 2, the piezoelectric body layer 52 is formed to cover a part of the first electrode 51. The shape of the piezoelectric body layer 52 is not specifically limited as long as the piezoelectric body layer 52 may be formed above the pressure chamber 21 to cover at least a part of the first electrode 51. For example, as shown in FIG. 1, the piezoelectric body layer 52 may be formed along the direction in which a plurality of the first electrodes 51 extend. Furthermore, although not shown in FIG. 1, the piezoelectric body layer 52 having a continuous plate shape may be formed to cover the plurality of the first electrodes 51.

The piezoelectric body layer 52 includes a polycrystalline body having piezoelectric properties, and can be deformed by a voltage applied thereto in the piezoelectric element 50. The structure and material of the piezoelectric body layer 52 are not specifically limited as long as the piezoelectric body layer 52 may have piezoelectric properties. For example, the piezoelectric body layer 52 is made of a well-known piezoelectric material by using a well-known method such as a sol-gel method. For example, the piezoelectric body layer 52 may be made of a lead-based piezoelectric material such as lead zirconate titanate ($Pb(Zr,Ti)O_3$), a non-lead-based piezoelectric material such as bismuth sodium titanate ($(Bi,Na)TiO_3$), barium titanate ($BaTiO_3$) and potassium sodium niobate ($(Na,K)NbO_3$).

As shown in FIG. 2, the second electrode 53 is formed above the pressure chamber 21 to overlap at least a part of the first electrode 51 and the piezoelectric body layer 52. Furthermore, as shown in FIG. 1, the second electrode 53 may be formed to continuously cover the overlap portions of a plurality of piezoelectric body layers 52 and the first electrode 51.

The structure and material of the second electrode 53 are not specifically limited. For example, the second electrode 53 may be formed of a single layer. Furthermore, the second electrode 53 may also be formed of a stack member of a plurality of films. For example, the second electrode 53 includes a layer having conductivity, and serves as the upper electrode of the piezoelectric element 50. For example, the second electrode 53 may be a conductive layer including platinum (Pt), iridium (Ir), gold (Au), nickel (Ni), titan (Ti), conductive oxide such as strontium oxide (SRO) and lanthanum nickel oxide (LNO), and the like.

Furthermore, although not shown in FIG. 2, the second electrode 53 may have a lead portion serving as a contact portion of the driving circuit (IC) 200. For example, the lead portion of the second electrode 53 may be formed in an area of the first surface 11, which is adjacent to a plurality of piezoelectric elements 50. The lead portion of the second electrode 53 may be made of metal similarly to the first electrode 51. Although not shown in FIG. 2, the lead portion of the second electrode 53 may be formed of a metal layer including a stack member having nickel-chrome alloy (NiCr), gold (Au) and the like.

With any one of the above configurations, the piezoelectric element 50 including the piezoelectric body layer 52 interposed between the first electrode 51 and the second electrode 53 can be configured above the pressure chamber 21. Furthermore, when a plurality of pressure chambers 21 are formed, the piezoelectric elements 50 can be formed above the plurality of pressure chambers 21, respectively.

With the above structures, the piezoelectric body layer 52 serving as an active section of the piezoelectric element 50 can be covered by the second electrode 53 to protect the piezoelectric element 50 from the influence of external factors such as moisture in the air, so that the reliability of the liquid droplet ejecting head 300 can be improved.

As shown in FIGS. 1 and 2, the liquid droplet ejecting head 300 in accordance with the embodiment includes a support substrate 60 capable of protecting the piezoelectric element 50. The support substrate 60 has a space 69 capable of containing a plurality of piezoelectric elements 50 in a predetermined space area. The space 69 may be a space area to the extent that the deformation movement of the piezoelectric elements 50 is not disturbed. The support substrate 60 may have an internal wiring (not shown). Furthermore, the support substrate 60 may be a member with no wiring and the like. Moreover, the support substrate 60 may also be a molded interconnect device (MID).

As shown in FIG. 2, the support substrate 60 includes a first member 61 formed on the first surface 11 of the diaphragm 10, and a second member 66 formed on the first member 61.

The first member 61 constitutes a sidewall portion of the space 69. As shown in FIG. 3A, the first member 61 has a plate shape and is formed with a first opening 62, and the piezoelectric element 50 can be contained in the first opening 62. The first member 61 may have a thickness (height from the first surface 11) to the extent that the deformation movement of the piezoelectric elements 50 is not disturbed. The shape and area of the first opening 62 are not specifically limited as long as the first opening 62 may be appropriately determined by the design of the piezoelectric element 50. For example, when the piezoelectric elements 50 are arranged in a row in a predetermined direction, the first opening 62 may have a rectangular shape with a long side in the arrangement direction of the piezoelectric element 50.

Furthermore, as shown in FIGS. 2 and 3A, the first member 61 is formed with an opening 63 which communicates with the reservoir 25 and the opening 15. The shape of the opening 63 is not specifically limited as long as liquid matter such as ink can be supplied to the reservoir 25. For example, the opening 15 may also have the same shape as that of the opening 63.

The main material of the first member 61 is resin. The resin serving as the main material of the first member 61 is may be made of a photosensitive adhesive composite. The photosensitive adhesive composite has photosensitivity which allows a predetermined pattern shape to be achieved through an exposure and development process using a well-known photolithography technology. Furthermore, the photosensitive adhesive composite is a resin composite having adhesive properties while maintaining the pattern through a heating process even after the pattern is formed.

The material of the resin constituting the first member 61 is not specifically limited as long as it is a photosensitive adhesive composite. For example, the first member 61 may include a resin member made of a resin composite employing epoxy resin as a main component. For example, the first member 61 may also include a resin member made of a photosensitive adhesive composite according to JP-A-2009-46569 and JP-A-2006-321984. In detail, the photosensitive adhesive composite may include resin composite which mainly contains epoxy resin with a low epoxy equivalent weight such as glycidyl ether type epoxy resin, epoxy resin with a high epoxy equivalent weight such as bisphenol A type phenoxy resin and bisphenol F type phenoxy resin, and photoacid generator. In addition, the photosensitive adhesive composite may be obtained by adding modified phenol novolac resin, epoxy resin and photoradical generator at a predetermined ratio. Moreover, the photosensitive adhesive composite may appropriately contain an adhesion promoter such as a silane coupling agent, filler, pigment, flame retarder, release agent, leveling agent, organic solvent, developer, polyimide and the like.

The second member 66 serves as a cover of the space 69. As shown in FIG. 3B, the second member 66 has a plate shape, and for example, is formed with a second opening 67 which communicates with the first opening 62 and has an area smaller than that of the first opening 62. The shape and area of the second opening 67 are not specifically limited as long as the driving circuit (IC) 200 arranged on the second member 66 can be electrically connected to the first electrode 51 and the second electrode 53 of the piezoelectric element 50. For example, as shown in FIG. 2, when the first electrode 51 is wire-bonded to the driving circuit (IC) 200 by using a wire 230, the second opening 67 may have an area where the wire 230 can be wire-bonded to the first electrode 51.

Although not shown in FIG. 2, when the lead portions of the first electrode 51 and the second electrode 53 of the piezoelectric element 50 are drawn out of the space 69 from the first surface 11, the second member 66 may not be formed with the second opening 67. In such a case, for example, the driving circuit (IC) 200 is electrically connected to the piezoelectric element 50 in an area outside of the space 69 through wire-bonding.

Furthermore, as shown in FIGS. 2 and 3B, the second member 66 is formed with an opening 68 which communicates with the reservoir 25 through the opening 15 and the opening 63. The shape of the opening 68 is not specifically limited as long as liquid matter such as ink can be supplied to the reservoir 25. For example, the opening 68 may also have the same shape as that of the opening 63.

The material of the second member 66 is not specifically limited. For example, the second member 66 may be made of single crystalline silicon, nickel, stainless, stainless steel, glass ceramic and the like. Furthermore, although not shown in FIGS. 2 and 3B, the second member 66 may be made of resin similarly to the first member 61.

As shown in FIGS. 1 and 2, the driving circuit (IC) 200 may be mounted on the second member 66 of the support substrate 60 through electrical connection sections 210.

Furthermore, as shown in FIGS. 1 and 2, a flexible film 70 and a fixing film 71 may be formed above the opening 68 of the second member 66. The flexible film 70 is formed to seal the opening 68. For example, the flexible film 70 may be made of poly-phenylene-sulfide (PPS) film. Furthermore, the fixing film 71 is formed with an opening 73 above the opening 68 through the flexible film 70. The fixing film 71 is not specifically limited as long as the fixing film 71 can fix the flexible film 70. For example, the fixing film 71 may be made of a metal material such as stainless steel. When the space defined by the reservoir 25 of the fluid path forming plate 20, and the opening 63 and the opening 68 of the support substrate 60 is referred to as a reservoir 80, one surface of the reservoir 80 is sealed only by the flexible film 70.

In addition, for example, the liquid droplet ejecting head 300 may be made of various resin materials and various metal materials, and may have a housing (not shown) capable of containing the above-described configurations.

With any one of the above configurations, the configuration of the liquid droplet ejecting head 300 in accordance with the embodiment can be achieved. The liquid droplet ejecting head 300 having such a configuration receives liquid matter from an external supply unit (not shown), fills an internal fluid path from the reservoir 80 to the nozzle holes 31 with the liquid matter, and then applies the liquid matter to a corresponding piezoelectric element 50 in response to a driving signal of the driving circuit (IC) 200. Thus, since the piezoelectric element 50 is deformed to cause the deformation of the diaphragm 10, the internal pressure of the pressure chamber 21 is increased, so that liquid droplets with a desired volume are discharged through the nozzle holes 31.

For example, the liquid droplet ejecting head 300 in accordance with the embodiment has the following characteristics.

According to the liquid droplet ejecting head 300 in accordance with the embodiment, it is possible to provide the liquid droplet ejecting head 300 with no adhesive between the support substrate 60 and the diaphragm 10 on which the piezoelectric element 50 is formed. Thus, since no adhesive is used at the time of a process of gluing the support substrate 60 to the diaphragm 10, the adhesive having fluidity is prevented from being introduced into the reservoir 80 serving as an ink path, the space 69 in which the piezoelectric element 50 is formed, and the like. Consequently, it is possible to provide a liquid droplet ejecting head with high reliability.

Furthermore, according to the liquid droplet ejecting head 300 in accordance with the embodiment, it is possible to simplify an etching process of the support substrate 60 and omit an adhesive transfer process for boning the support substrate 60 to the diaphragm. Consequently, it is possible to provide a liquid droplet ejecting head manufactured by a simple process with high productivity. A detailed description thereof will be given later.

2. Method for Manufacturing Liquid Droplet Ejecting Head

Hereinafter, the liquid droplet ejecting head 300 in accordance with the embodiment and the method for manufacturing the liquid droplet ejecting head 300 will be described with reference to the accompanying drawings.

Figure 4:
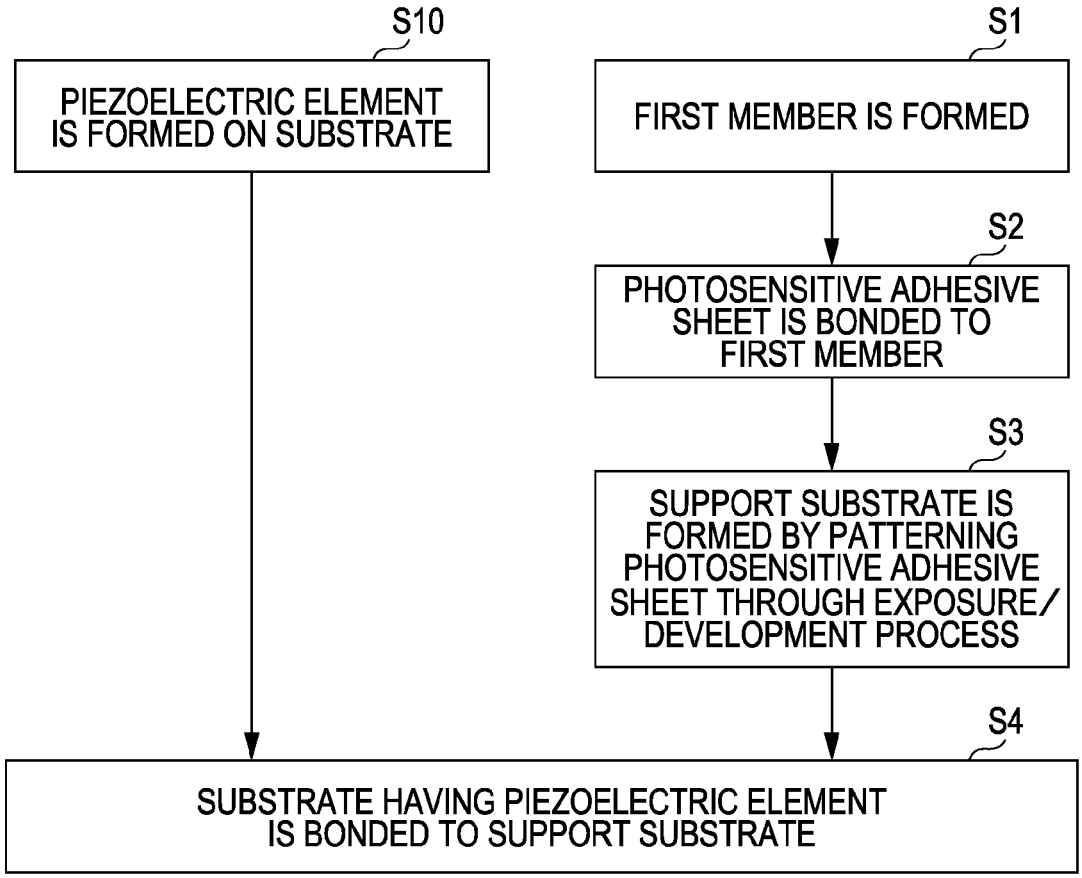
FIG. 4 is a flow chart showing a method for manufacturing a liquid droplet ejecting head in accordance with an embodiment.

FIG. 4 is a flow chart showing the method for manufacturing the liquid droplet ejecting head in accordance with the embodiment. FIGS. 5A to 5D, FIGS. 6A and 6B, FIG. 7, FIGS. 8A and 8B, FIGS. 9 and 10, and FIGS. 11A and 11B are sectional views schematically showing the method for manufacturing the liquid droplet ejecting head 300 in accordance with the embodiment.

The method for manufacturing the liquid droplet ejecting head in accordance with the embodiment is different when using single crystalline silicon and the like in order to form the fluid path forming plate 20 and the nozzle plate 30 and when using stainless and the like in order to form the fluid path forming plate 20 and the nozzle plate 30. Hereinafter, the method for manufacturing the liquid droplet ejecting head by using single crystalline silicon will be described as one example. The method for manufacturing the liquid droplet ejecting head in accordance with the embodiment is not specifically limited to the following manufacturing method, and for example, may include processes of a well-known electroforming method and the like when using nickel, stainless steel, stainless and the like as a material.

Furthermore, the sequence of process steps is not limited to the manufacturing method described below. Although not shown in FIG. 4, for example, after the fluid path of the pressure chamber 21 and the like is formed in the fluid path forming plate 20, the piezoelectric element 50 may be formed and the support substrate 60 may be glued. Alternatively, after the piezoelectric element 50 is formed, the fluid path of the pressure chamber 21 and the like may be formed in the fluid path forming plate 20 and the support substrate 60 may be glued.

In addition, as described above, the piezoelectric element 50 in accordance with the embodiment may be any one of the unimorph-type piezoelectric element in the bending vibration mode (bending mode) and the stacked piezoelectric element in the stretching vibration mode (piston mode). Hereinafter, the manufacturing method described below will be described as one example of a manufacturing method when the piezoelectric element 50 is the unimorph-type piezoelectric element in the bending vibration mode (bending mode).

As shown in FIG. 4, according to the method for manufacturing the liquid droplet ejecting head in accordance with the embodiment, the second member 66 is formed from a first substrate 66*a* (S1), a photosensitive adhesive film 61*a* is glued to the second member 66 (S2), the first member 61 is formed by patterning the photosensitive adhesive film 61*a* through the exposure and development process, thereby forming the support substrate 60 (S3), the piezoelectric element 50 is formed on a second substrate 1 (S10), and the support substrate 60 is glued to the second substrate 1 such that the piezoelectric element 50 is contained in the space 69 (S4).

First, after steps S1 to S3 for forming the support substrate 60 are described with reference to FIGS. 5A to 5D, one example of a manufacturing method of the piezoelectric element 50 will be described.

Figure 5A:
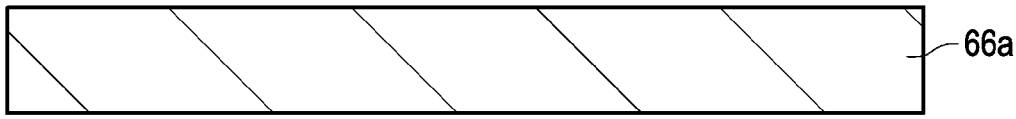
FIGS. 5A to 5D are sectional views schematically showing a method for manufacturing a liquid droplet ejecting head in accordance with an embodiment.

As shown in FIG. 5A, the first substrate 66*a* serving as a base material of the second member 66 is prepared. Since the material of the first substrate 66*a* refers to the description of the material of the above-described second member 66, a detailed description thereof will be omitted.

Figure 5B:
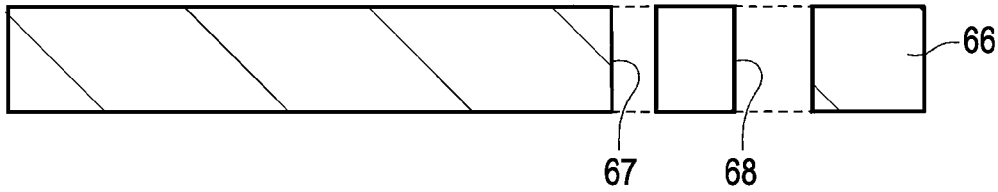

Next, as shown in FIG. 5B, the second opening 67 and the opening 68 may be formed in predetermined positions of the first substrate 66*a*. When the second opening 67 is not necessary, only the opening 68 may be formed. In this way, the second member 66 is formed (S1). A method for forming the second opening 67 and the opening 68 may use a well-known cutting method, and is not specifically limited. For example, it may be possible to perform mechanical cutting by using a sand blaster, laser beam irradiation, a blade, dry etching and the like, or wet etching and the like.

Figure 5C:
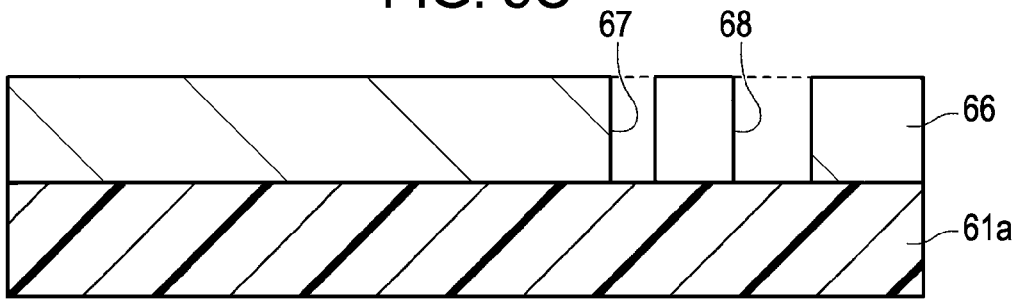

Then, as shown in FIG. 5C, the photosensitive adhesive sheet 61*a* is glued to the second member 66 to cover the second opening 67 and the opening 68 of the second member 66 (S2). The photosensitive adhesive sheet 61*a* is formed in a sheet shape from the above-described photosensitive adhesive composite. Thus, the photosensitive adhesive sheet 61*a* may have formability for the photolithography technology, and have adhesive properties while maintaining the pattern shape after the pattern is formed. Since a detailed description of the photosensitive adhesive composite has been given above, additional description thereof will be omitted. As compared with the case of using a liquid phase material, the photosensitive adhesive sheet 61*a* formed in the sheet shape from the photosensitive adhesive composite is used, so that the workability can be improved. In addition, for the second member 68 formed with the opening, since it is not necessary to mask the opening, the process can be simplified.

As described above, since the photosensitive adhesive sheet 61*a* has the adhesive properties, the photosensitive adhesive sheet 61*a* can be directly glued to the second member 66.

Furthermore, the photosensitive adhesive sheet 61*a* may be positive type resist, in which a portion exposed by energy line such as radiation is selectively removed by developer, or negative type resist in which an unexposed portion is selectively removed by the developer.

In the gluing process, the photosensitive adhesive sheet 61*a* is subject to a heat treatment process by using a well-known heating method, so that the adhesive properties can be produced. For example, the photosensitive adhesive sheet 61*a* may be subject to the heat treatment process at the temperature of 150° C. to 200° C.

The photosensitive adhesive sheet 61*a* may have a plane area larger than that of the second member 66, and may have at least a size capable of covering an area where the first member 61 is to be formed according to the design. Furthermore, the thickness of the photosensitive adhesive sheet 61*a* is not specifically limited as long as it is larger than the height (from the substrate on which the piezoelectric element 50 is formed) of the piezoelectric element 50. For example, the photosensitive adhesive sheet 61*a* may have a thickness of about 10 μm to about 50 μm.

As compared with a film forming method such as sputtering to which liquid-phase photosensitive adhesive composite is subject, the photosensitive adhesive sheet 61*a* is used for the gluing process, so that the photosensitive adhesive is prevented from being introduced into the opening of the second member 66 because the photosensitive adhesive does not have fluidity, and it is not necessary to mask the opening. Consequently, the manufacturing method of the liquid droplet ejecting head can be further simplified.

Figure 5D:
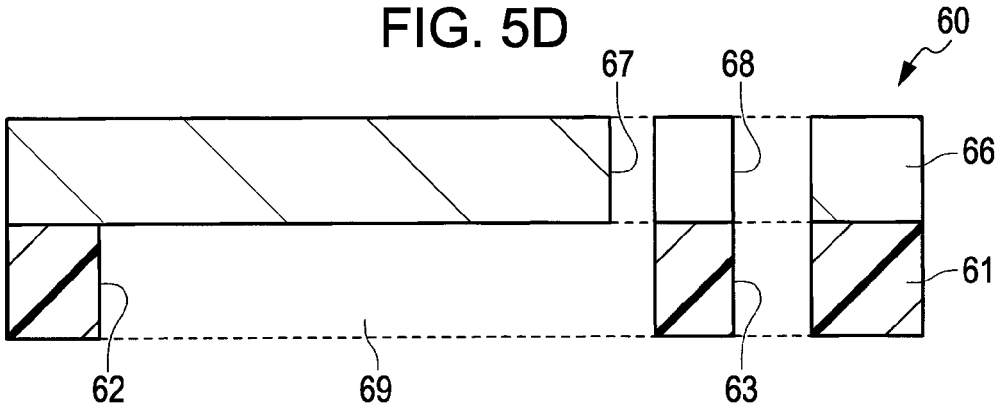

Last, as shown in FIG. 5D, the photosensitive adhesive sheet 61*a* is patterned through the exposure/development process by using the well-known photolithography technology, so that a desired shape is achieved (S3). In other words, the photosensitive adhesive sheet 61*a* is selectively exposed by the energy line such as radiation and is subject to the development process by using the developer, so that a specific area of the photosensitive adhesive sheet 61*a* is removed. Through the present process, as shown in FIG. 5D, the first opening 62 having an area capable of containing the piezoelectric element 50 and the opening 63 communicating with the opening 68 are formed. At this time, the first opening 62 may also be formed to communicate with the second opening 67.

Figure 13:
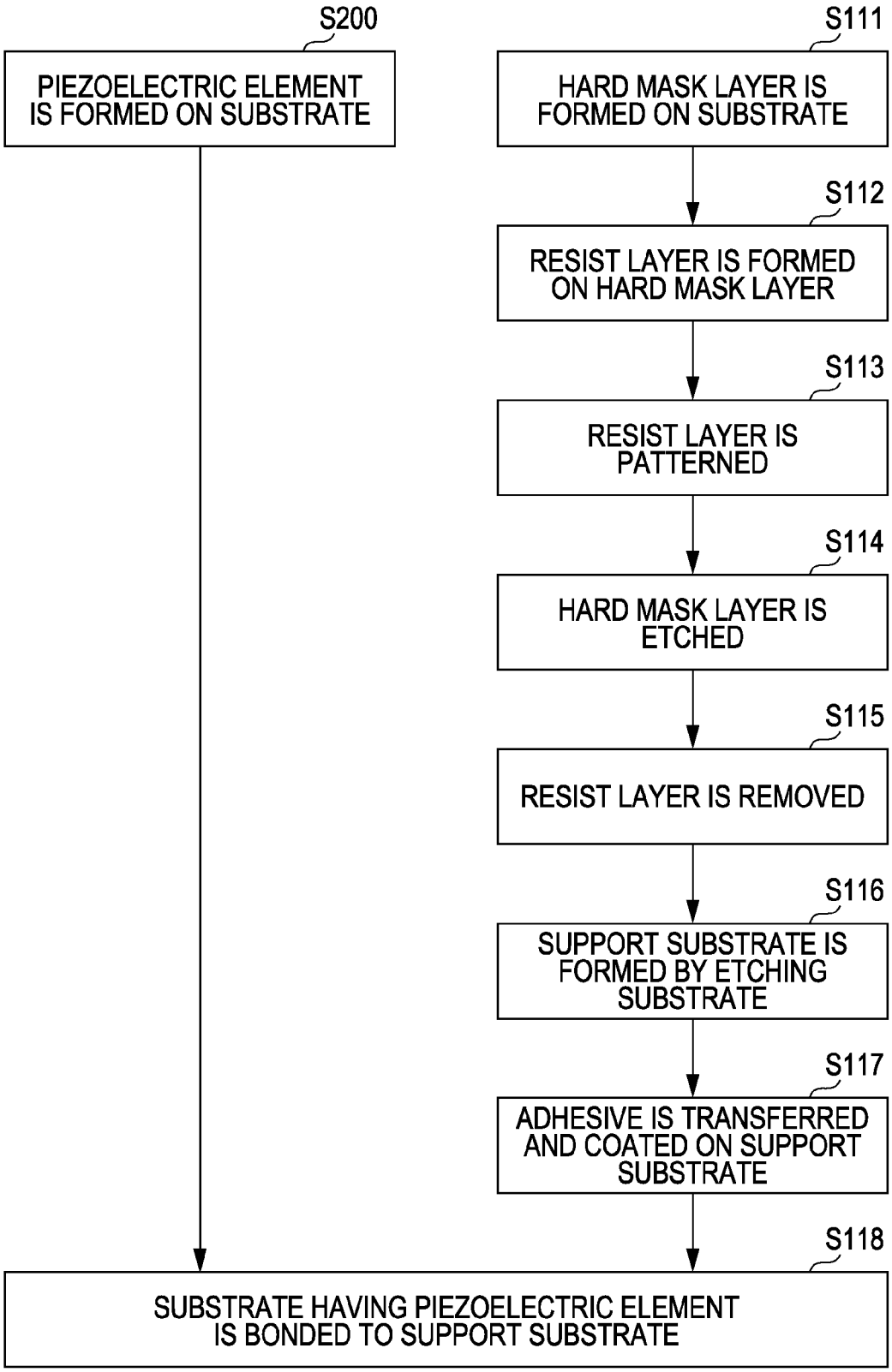
FIG. 13 is a flow chart showing a method for manufacturing a liquid droplet ejecting head in accordance with in accordance with the related art.

In this manner, the first member 61 glued to the second member 66 is formed, and the support substrate 60 including the first member 61 and the second member 66 is formed. Consequently, as compared with the manufacturing method of the support substrate from Steps S111 to S116 of FIG. 13, it is possible to provide the manufacturing method of the support substrate, in which the number of process steps can be reduced and the material of a hard mask layer, a resist layer and the like can be reduced. That is, it is possible to provide a simple manufacturing method of the support substrate with high productivity.

Hereinafter, the step S10 for forming the piezoelectric element 50 will be described with reference to FIGS. 6A and 6B, FIG. 7, FIGS. 8A and 8B and FIGS. 9 and 10.

Figure 6A:
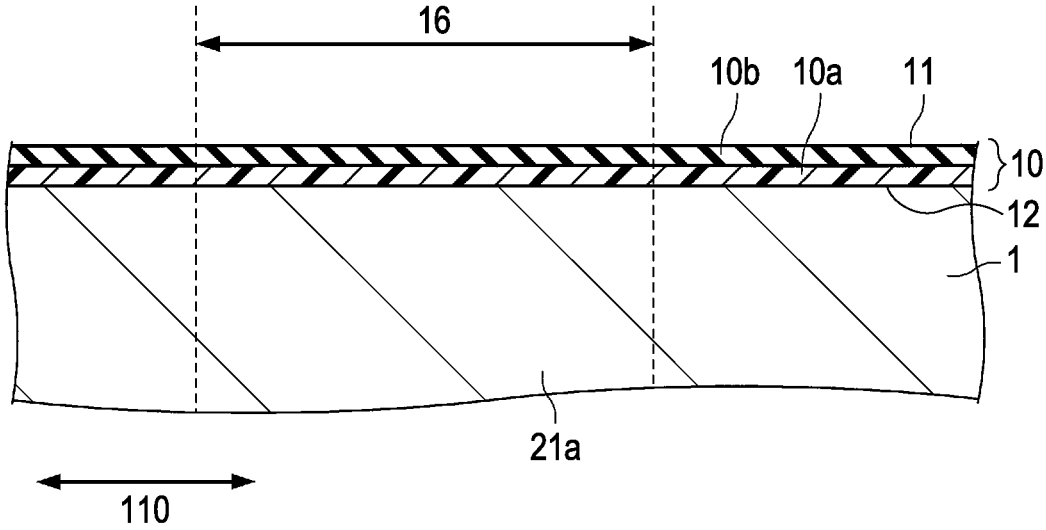
FIGS. 6A and 6B are sectional views schematically showing a method for manufacturing a liquid droplet ejecting head in accordance with an embodiment.

First, as shown in FIG. 6A, the diaphragm 10 is prepared on the second substrate 1 made of prepared single crystalline silicon. As shown in FIG. 6A, in the manufacturing process which will be described later, an area where the pressure chamber 21 of the second substrate 1 is to be formed will be referred to as an area 21*a*. Furthermore, an area of the first surface 11 of the diaphragm 10, which overlaps the area 21*a*, will be referred to as a movable area 16.

The diaphragm 10 may be formed using a well-known film forming technology or a heat treatment process. As shown in FIG. 6A, for example, the diaphragm 10 may be formed in such a manner that an elastic layer 10*a* constituting an elastic plate is formed through a sputtering method, a heat treatment process and the like, and then an insulation layer 10*b* is formed on the elastic layer 10*a* through the sputtering method, the heat treatment process and the like. For example, the second substrate 1 made of the single crystalline silicon is subject to the heat treatment process to thermally oxidize the surface of the second substrate 1, so that the elastic layer 10*a* made of silicon oxide may be formed. Furthermore, a zirconium layer is formed on the elastic layer 10*a* through the sputtering method and the like, and then is subject to the heat treatment process for thermal oxidization, so that the insulation layer 10*b* made of the zirconium oxide may be formed.

Figure 6B:
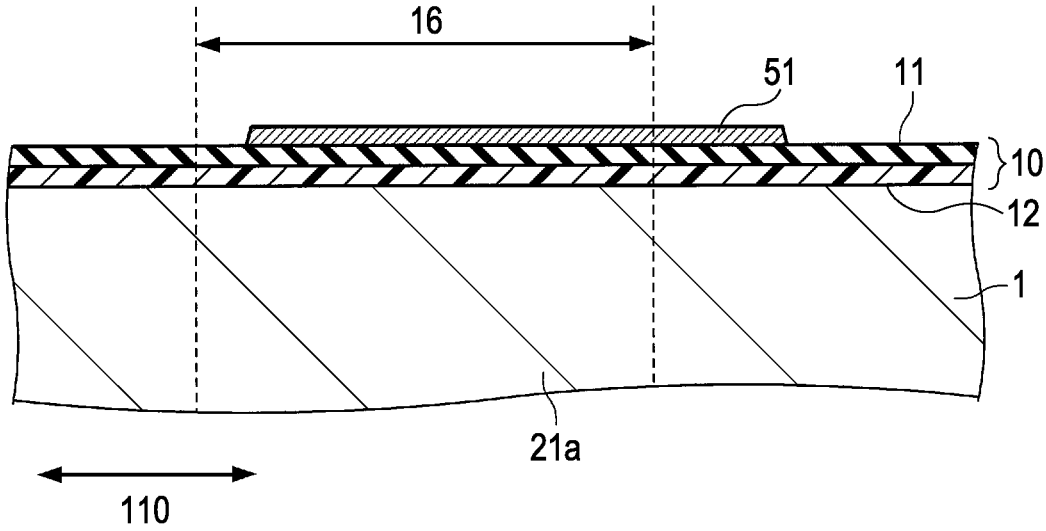

Then, as shown in FIG. 6B, the first electrode 51 is formed on the first surface 11 of the diaphragm 10. Herein, in the movable area 16, the first electrode 51 may be patterned in a desired shape such that the first electrode 51 extends in a first direction 110 serving as one direction on the diaphragm 10. Furthermore, although not shown in FIG. 6B, the first electrode 51 may be provided in a plural number along a second direction 120 crossing the first direction 110. The first electrode 51 may be formed using a well-known film forming technology. For example, the first electrode 51 may be formed in such a manner that a conductive layer (not shown) is formed by stacking platinum, iridium and the like through the sputtering method and the like, and is etched to have a predetermined shape. In addition, since the detailed description of the first electrode 51 has been given above, additional description thereof will be omitted.

Although not shown in FIG. 6B, after the conductive layer is formed on the entire surface of the first surface 11, when patterning the first electrode 51, an underlayer including the conductive layer may be formed on the first surface 11 while avoiding at least the movable area 16. The underlayer is a conductive layer which is electrically insulated from the first electrode 51. Consequently, since the growth interface of the piezoelectric body layer 52, which will be described layer, can be used as an interface including a conductive layer, it is possible to form the piezoelectric body layer 52 in which crystalline growth is uniformly controlled. Furthermore, although not shown in FIG. 6B, a conductive layer 55*a* may be formed in an area where the opening 15 of the diaphragm 10 is to be formed (refer to FIG. 2).

In addition, although not shown in FIG. 6B, before the conductive layer for forming the first electrode 51 is patterned by an etching process, an etching protective layer may be formed on the conductive layer, and the first electrode 51 may be etched. The etching protective layer may be a piezoelectric body layer made of a piezoelectric material, which is the same as the piezoelectric body layer 52 which will be described later. The etching protective layer may be formed in at least an area where the first electrode 51 patterned in a desired shape is to be formed. Consequently, in the etching process of patterning the first electrode 51, the surface of the first electrode 51 can be protected from damage by etchant used.

Figure 7:
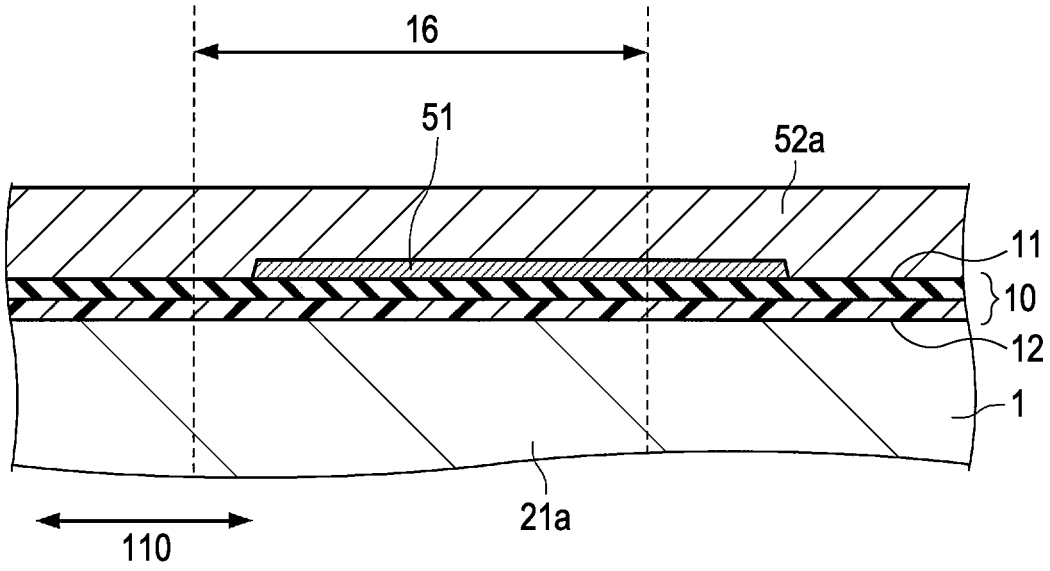
FIG. 7 is a sectional view schematically showing a method for manufacturing a liquid droplet ejecting head in accordance with an embodiment.

Then, as shown in FIG. 7, a piezoelectric body layer 52*a* is formed to cover the first electrode 51. The piezoelectric body layer 52*a* is patterned to form the piezoelectric body layer 52. A detailed description thereof will be given later. The piezoelectric body layer 52*a* may be formed using a well-known film forming technology. For example, the piezoelectric body layer 52*a* may also formed by coating precursor serving as a well-known piezoelectric material on the first surface 11, and heating the precursor. The precursor used is not specifically limited as long as it is burn by a heating process and is subject to a polarization treatment process to produce piezoelectric properties. For example, it may also be possible to use precursor such as lead zirconate titanate. In addition, when the etching protective layer is formed, since the etching protective layer is made of a piezoelectric material similarly to the piezoelectric body layer 52*a* (the piezoelectric body layer 52), the etching protective layer can be integrally formed with the piezoelectric body layer 52*a* after being burned.

Although not shown in FIG. 7, for example, in the case of forming the piezoelectric body layer 52*a* (the piezoelectric body layer 52) by using lead zirconate titanate, after an intermediate titanium layer made of titanium is formed on the entire surface of the first surface 11, the precursor serving as the piezoelectric material may be coated thereon. Consequently, when the piezoelectric body layer 52*a* is crystal-grown by heating the precursor, an interface for growing the crystal of the precursor can be unified with the intermediate titanium layer. In other words, the piezoelectric body layer 52*a* crystal-grown on the diaphragm 10 can be removed. Thus, the crystal growing of the piezoelectric body layer 52*a* can be efficiently controlled, and the piezoelectric body layer 52*a* can become piezoelectric crystal with high orientation. In addition, the intermediate titanium layer can be taken into the crystal of the piezoelectric body layer 52*a* at the time of the heating process.

Figure 8A:
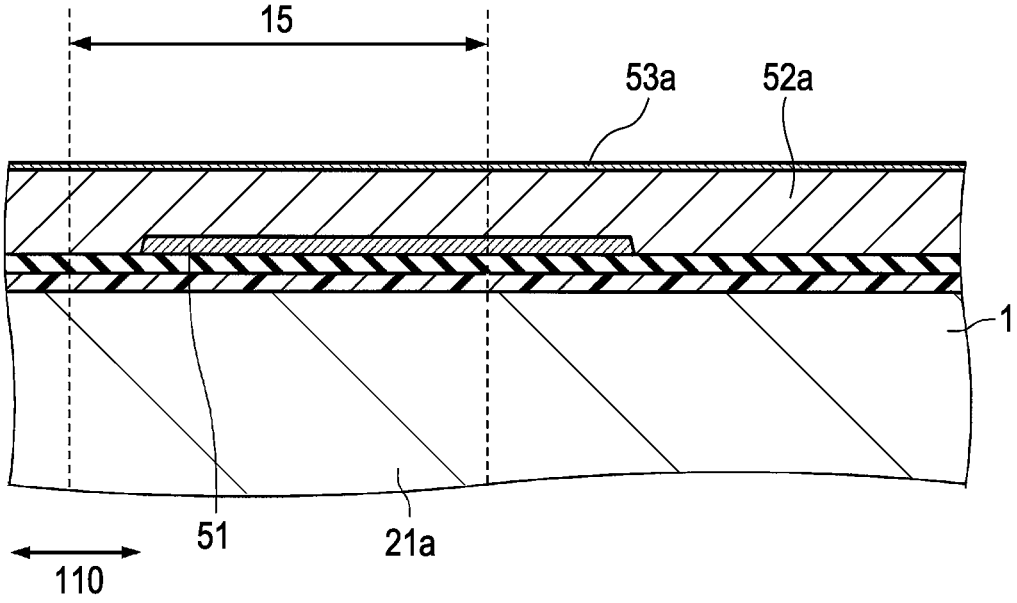
FIGS. 8A and 8B are sectional views schematically showing a method for manufacturing a liquid droplet ejecting head in accordance with an embodiment.

Then, as shown in FIG. 8A, before the piezoelectric body layer 52*a* is patterned in a desired shape by an etching process, a mask layer 53*a* with conductivity may be formed to cover the piezoelectric body layer 52*a*. The mask layer 53*a* is a conductive layer made of a material the same as that of the second electrode 53 which will be described later. The mask layer 53*a* has a pattern with a desired shape.

Figure 8B:
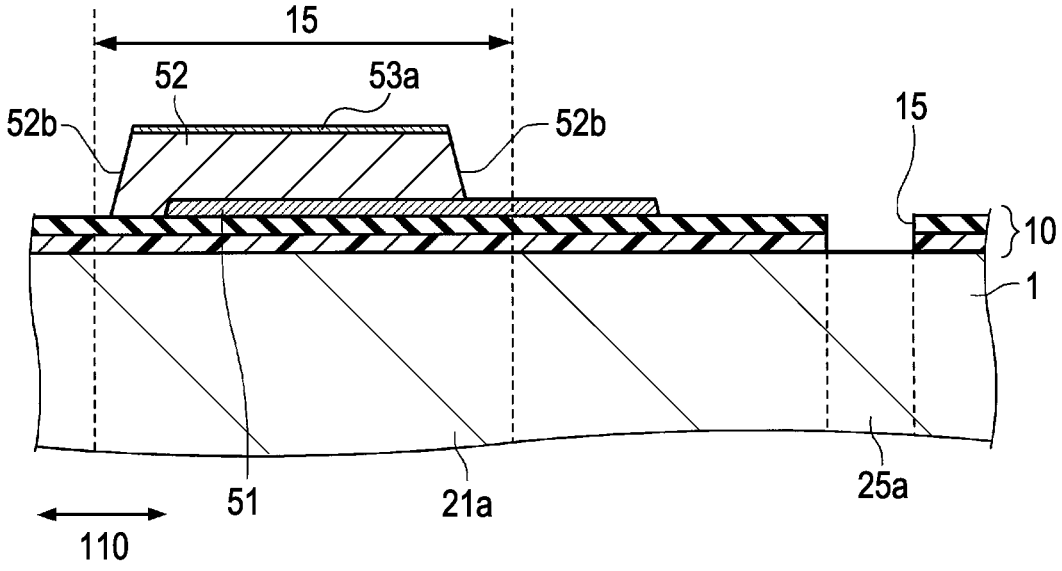

As shown in FIG. 8B, after the mask layer 53*a* is formed, the piezoelectric body layer 52*a* is patterned in the desired shape by the etching process. Herein, the mask layer 53*a* is formed, so that the piezoelectric body layer 52 can be easily provided with a side surface 52*b* having a tapered shape as shown in FIG. 8B because the mask layer 53*a* serves as a hard mask in the etching process.

Herein, as shown in FIG. 8B, an area, which is located on an area 25*a* where the reservoir 25 of the diaphragm 10 is to be formed, may be formed with the opening 15, through which the second substrate 1 is exposed, by patterning the diaphragm 10.

Furthermore, although not shown in FIG. 8B, when the lead portion of the first electrode 51 is formed through the contact hole formed in the piezoelectric body layer 52, the first electrode 51 may be formed with a contact hole by patterning the piezoelectric body layer 52 such that the first electrode 51 is not exposed.

Figure 9:
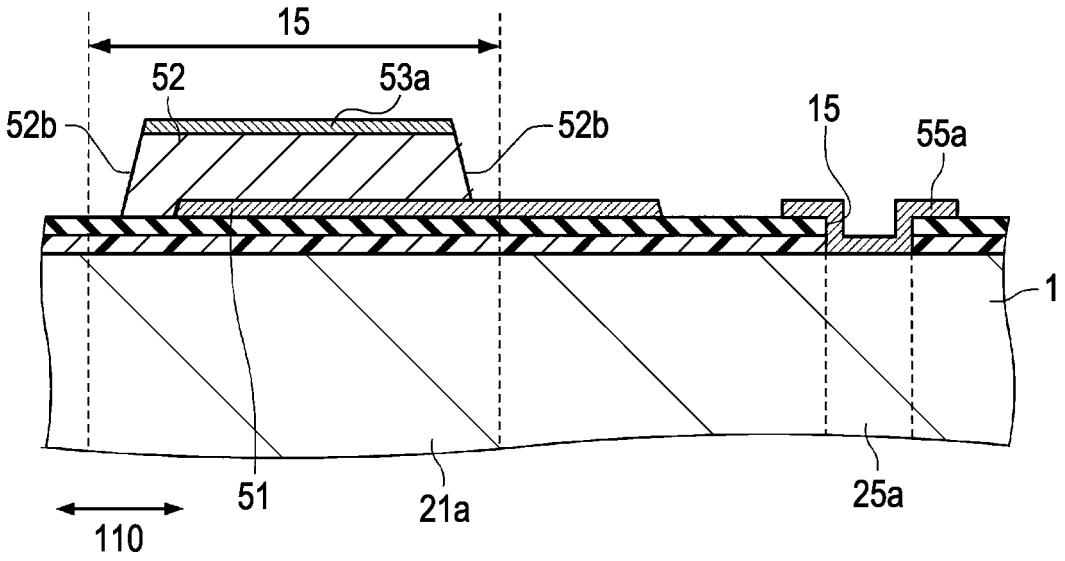
FIG. 9 is a sectional view schematically showing a method for manufacturing a liquid droplet ejecting head in accordance with an embodiment.

Then, as shown in FIG. 9, a conductive layer is formed on the mask layer 53*a* through the sputtering method and the like and is patterned in a desired shape, so that the second electrode 53 is formed. Although not shown in FIG. 9, the second electrode 53 may also be formed to continuously cover a plurality of adjacent piezoelectric body layers 52 along the second direction 120. In addition, since the detailed description of the second electrode 53 has been given above, additional description thereof will be omitted.

As shown in FIG. 9, in the process of forming the second electrode 53, the conductive layer 55*a* may also be formed to continuously cover the second substrate 1 in the opening 15 and around the opening 15. Consequently, the conductive layer 55*a* can serve as an etching stopper when partitioning the reservoir 25 and the like in the second substrate 1.

In this way, the piezoelectric element 50 can be formed.

Hereinafter, the step of gluing the support substrate 60 to the substrate having the piezoelectric element 50 will be described with reference to FIG. 10 (S4).

Figure 10:
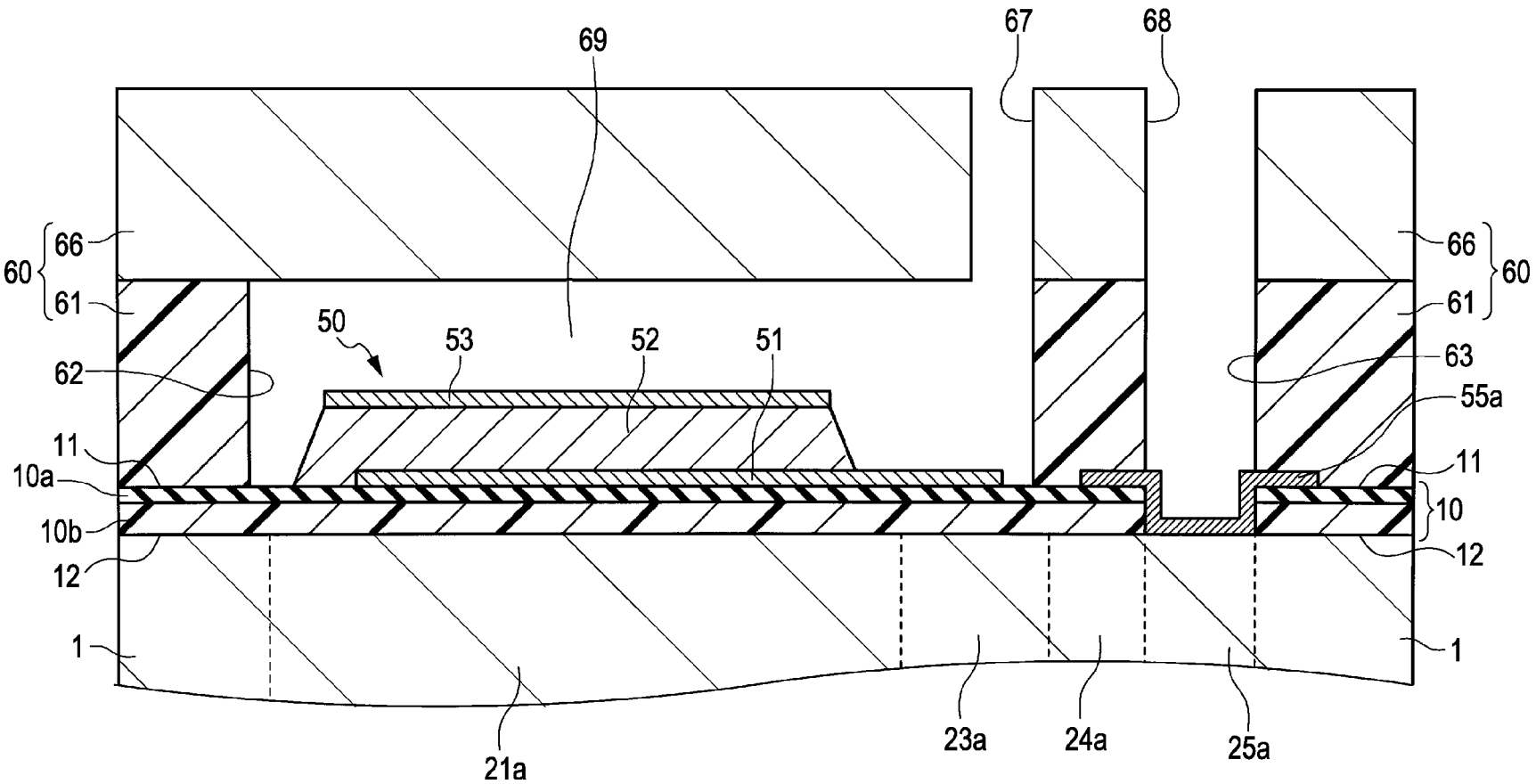
FIG. 10 is a sectional view schematically showing a method for manufacturing a liquid droplet ejecting head in accordance with an embodiment.

As shown in FIG. 10, the support substrate 60 is glued to the upper surface of the diaphragm 10 such that the piezoelectric element 50 is contained in the space 69 defined by the first opening 62 and the second member 66 of the support substrate 60. In Step S4, since the adhesive properties of the first member 61 can be used for the gluing process, it is not necessary to additionally use an adhesive. Further, as shown in FIG. 10, the opening 63 of the first member 61 can be located above the area 25*a* in the second substrate 1, where the reservoir 25 is to be formed. Herein, a part of the peripheral portion of the opening 63 of the first member 61 may be glued to the upper surface of the conductive layer 55*a*.

In Step S4, at the time of the gluing process, the first member 61 is subject to a heat treatment process by using a well-known heating method, thereby producing adhesive properties. The temperature of the heat treatment process is not specifically limited as long as the first member 61 can produce the adhesive properties. For example, the temperature may be in the range of 150° C. to 200° C.

Figure 11A:
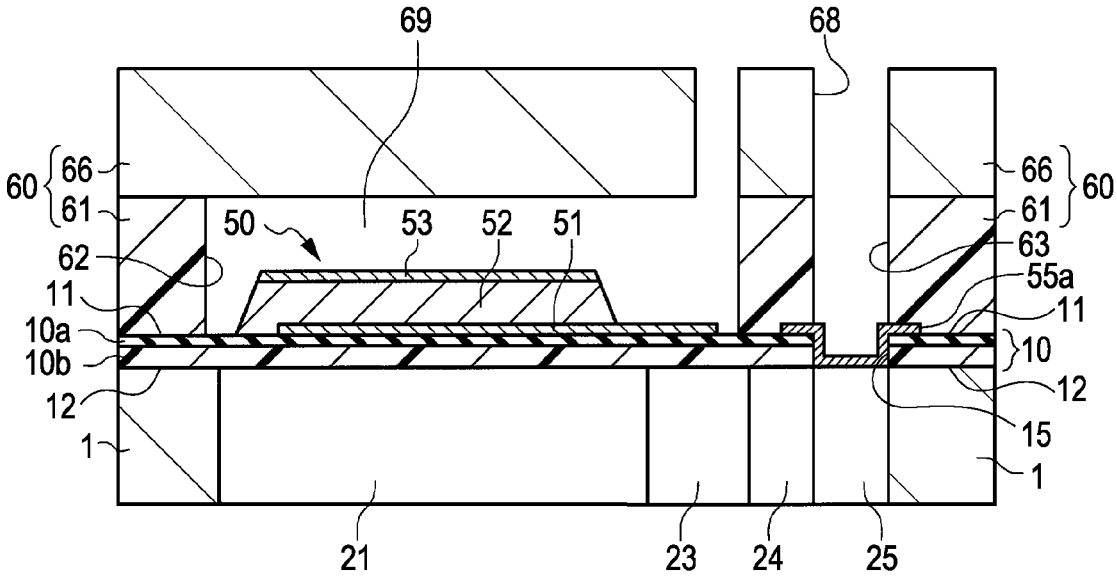
FIGS. 11A and 11B are sectional views schematically showing a method for manufacturing a liquid droplet ejecting head in accordance with an embodiment.

Then, as shown in FIG. 11A, the second substrate 1 is thinned to a predetermined thickness to partition the pressure chamber 21, the reservoir 25 and the like. For example, a mask (not shown) is formed on an opposite surface of the surface on which the diaphragm 10 is formed such that the second substrate 1 having the predetermined thickness is patterned in a desired shape, and the second substrate 1 is subject to an etching process, thereby partitioning the pressure chamber 21, the wall portion 22, the supply path 23, the communication path 24 and the reservoir 25. Consequently, the fluid path forming plate 20 having the pressure chamber 21 can be formed under the diaphragm 10. Herein, as shown in FIG. 11A, when the second substrate 1 is etched, the conductive layer 55*a* can be used as an etching stopper. After a predetermined fluid path is formed in the fluid path forming plate 20, the conductive layer 55*a* in the opening 15 may be removed. Consequently, the reservoir 80 including the reservoir 25, the opening 15, the opening 63 and the opening 68 may be formed.

Figure 11B:
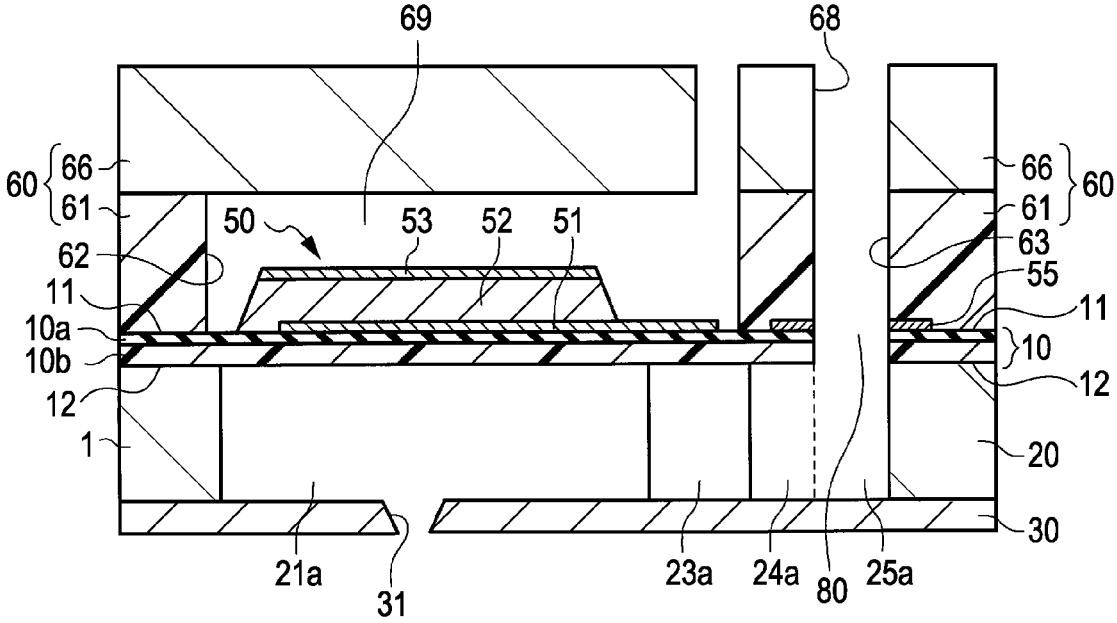

Then, after the fluid path forming plate 20 is formed, as shown in FIG. 11B, the nozzle plate 30 formed with the nozzle holes 31 is glued to a predetermined position by using an adhesive and the like. Consequently, the nozzle holes 31 communicate with the pressure chamber 21.

By the use of any one of the above-described methods, the liquid droplet ejecting head 300 can be manufactured. In addition, as described above, the liquid droplet ejecting head 300 and the manufacturing method of the liquid droplet ejecting head 300 are not limited to the above-described manufacturing methods. For example, the fluid path forming plate 20 may also be integrally formed with the nozzle plate 30 by using an electroforming method and the like.

The manufacturing method of the liquid droplet ejecting head in accordance with the embodiment, for example, has the following characteristics.

According to the manufacturing method of the liquid droplet ejecting head 300 in accordance with the embodiment, since the photosensitive adhesive sheet is used, the etching process of the support substrate 60 can be simplified. Consequently, the cost of a material such as a hard mask and resist can be reduced.

Furthermore, according to the manufacturing method of the liquid droplet ejecting head 300 in accordance with the embodiment, in the process of gluing the support substrate 60 to the substrate having the piezoelectric element 50, since it is not necessary to use an adhesive, the transfer coating process of the adhesive can be omitted. Consequently, the cost of the adhesive, transfer equipment and the like can be reduced.

In addition, in the case of using an adhesive, since the adhesive has viscosity, the adhesive may not easily be coated with a certain thickness or less and has fluidity. Therefore, it is probable that the adhesive may flow into the ink supply path formed in the fluid path forming plate and the like at the time of the gluing process and the ink path may not be sufficiently ensured in actual use. Further, in the case of using an adhesive having fluidity, it is probable that liquid dripping and the like may occur in the transfer process of the adhesive, thereby causing the reduction in the yield of the manufacturing process. Compared with this, according to the manufacturing method of the liquid droplet ejecting head in accordance with the embodiment, since no adhesive is used, reliability can be further improved and the yield can be improved.

As described above, according to the manufacturing method of the liquid droplet ejecting head in accordance with the embodiment, it is possible to provide a simple manufacturing method with high productivity of the liquid droplet ejecting head.

3. Liquid Droplet Ejecting Apparatus

Figure 12:
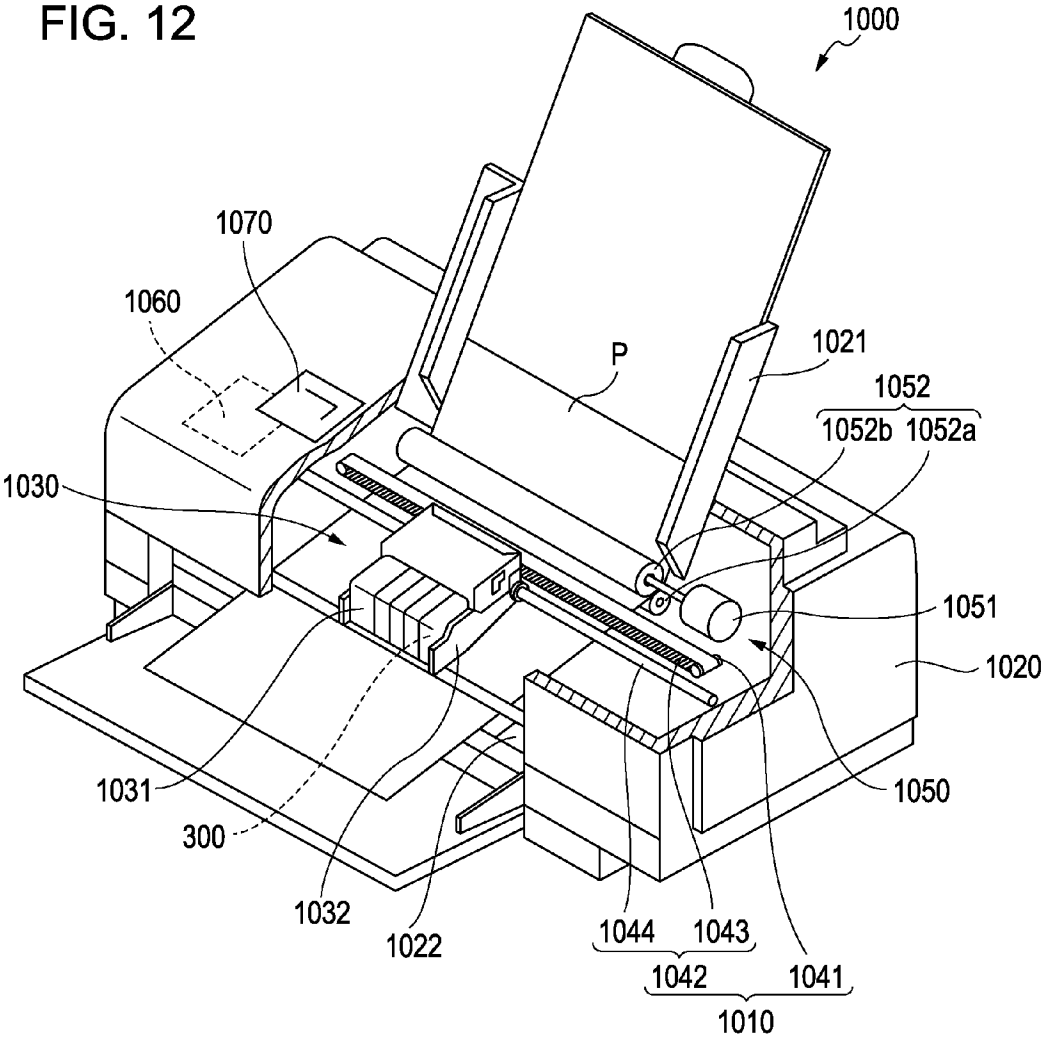
FIG. 12 is a perspective view schematically showing a liquid droplet ejecting apparatus in accordance with an embodiment.

Hereinafter, the liquid ejecting apparatus in accordance with the embodiment will be described. The liquid ejecting apparatus in accordance with the embodiment includes the liquid droplet ejecting head 300 in accordance with the invention. Herein, the case in which the liquid ejecting apparatus 1000 in accordance with the embodiment is an ink jet printer will be described. FIG. 12 is a perspective view schematically showing the liquid ejecting apparatus 1000 in accordance with the embodiment.

The liquid ejecting apparatus 1000 includes a head unit 1030, a driving unit 1010 and a control unit 1060. Furthermore, the liquid ejecting apparatus 1000 may include an apparatus body 1020, a paper feed unit 1050, a tray 1021 on which recording papers P are loaded, a discharge port 1022 that discharges the recording paper P, and an operation panel 1070 disposed on the apparatus body 1020.

For example, the head unit 1030 has an ink jet type recording head (hereinafter, simply referred to as "a head") including the above-described liquid droplet ejecting head 300. Furthermore, the head unit 1030 includes an ink cartridge 1031 that supplies the head with ink, and a transport unit 1032 (a carriage) coupled to the head and the ink cartridge 1031.

The driving unit 1010 may allow the head unit 1030 to reciprocate. The driving unit 1010 includes a carriage motor 1041 serving as a driving source of the head unit 1030, and a reciprocating mechanism 1042 that allows the head unit 1030 to reciprocate as the carriage motor 1041 rotates.

The reciprocating mechanism 1042 includes a carriage guide shaft 1044 having both ends supported by a frame (not shown), and a timing belt 1043 extending in parallel to the carriage guide shaft 1044. The carriage guide shaft 1044 supports the carriage 1032 while allowing the carriage 1032 to freely reciprocate. In addition, the carriage 1032 is fixed to a part of the timing belt 1043. If the timing belt 1043 is run by the operation of the carriage motor 1041, the head unit 1030 is guided by the carriage guide shaft 1044 and reciprocates. When the head unit 1030 reciprocates, ink is appropriately discharged from the head, so that printing to the recording paper P is performed.

The control unit 1060 can control the head unit 1030, the driving unit 1010, and the paper feed unit 1050.

The paper feed unit 1050 can transport the recording paper P to the head unit 1030 from the tray 1021. The paper feed unit 1050 includes a paper feed motor 1051 serving as a driving source of the paper feed unit 1050, and a paper feed roller 1052 that rotates together with the paper feed motor 1051. The paper feed roller 1052 includes a driven roller 1052*a* and a driving roller 1052*b*, which vertically face each other while interposing a transport path of the recording paper P therebetween. The driving roller 1052*b* is connected to the paper feed motor 1051. The paper feed unit 1050 is driven by the control unit 1060, the recording paper P passes through below the head unit 1030.

The head unit 1030, the driving unit 1010, the control unit 1060 and the paper feed unit 1050 are provided inside the apparatus body 1020.

The liquid ejecting apparatus 1000 can be provided with the liquid droplet ejecting head 300 in accordance with the invention. Consequently, it is possible to achieve the liquid ejecting apparatus 1000 with high reliability.

In addition, in the above-described example, the case in which the liquid ejecting apparatus 1000 is the ink jet printer has been described. However, the printer of the invention can be used as an industrial liquid ejecting apparatus. In such a case, as a liquid (a liquid phase material) discharged, it is possible to use a liquid which is obtained by allowing various functional materials to have predetermined viscosity by using a solvent or dispersion medium, liquid including metal flakes, and the like.

Although embodiments of the present invention have been described, it should be understood that numerous other modified examples can be devised by those skilled in the art that will fall within the spirit and scope of the present invention. Consequently, such modified examples are within the scope of the inventions.

What is claimed is:

1. A liquid droplet ejecting head comprising:
- a fluid path forming substrate having a fluid path communicating with nozzle holes;
- a diaphragm formed on the fluid path forming substrate;
- a piezoelectric element formed on the diaphragm and having a piezoelectric body layer interposed between a first electrode and a second electrode; and
- a support substrate formed on the diaphragm and having a space for containing the piezoelectric element,
- wherein the support substrate includes:
  - a first member formed on the diaphragm; and
  - a second member formed on the first member,
  - wherein the first member is formed with a first opening for containing the piezoelectric element,
  - the space of the support substrate is defined by the first opening of the first member and the second member, and
  - a main material of the first member is resin.

2. The liquid droplet ejecting head according to claim 1, wherein the resin serving as the material of the first member is formed from a photosensitive adhesive composite.

3. The liquid droplet ejecting head according to claim 1, wherein a material of the second member includes at least one of single crystalline silicon, glass, nickel, stainless steel and stainless.

4. The liquid droplet ejecting head according to claim 1, wherein the second member is formed with a second opening which communicates with the first opening of the first member, and has an area smaller than an area of the first opening.

5. A liquid droplet ejecting apparatus comprising:
- a liquid droplet ejecting head that includes:
  - a fluid path forming substrate having a fluid path communicating with nozzle holes;
  - a diaphragm formed on the fluid path forming substrate;
  - a piezoelectric element formed on the diaphragm and having a piezoelectric body layer interposed between a first electrode and a second electrode; and
  - a support substrate formed on the diaphragm and having a space for containing the piezoelectric element,
  - wherein the support substrate includes:
    - a first member formed on the diaphragm; and
    - a second member formed on the first member,
    - wherein the first member is formed with a first opening for containing the piezoelectric element,
    - the space of the support substrate is defined by the first opening of the first member and the second member, and
    - a main material of the first member is resin.

6. The liquid droplet ejecting apparatus according to claim 5, wherein the resin serving as the material of the first member is formed from a photosensitive adhesive composite.

7. The liquid droplet ejecting apparatus according to claim 5, wherein a material of the second member includes at least one of single crystalline silicon, glass, nickel, stainless steel and stainless.

8. The liquid droplet ejecting apparatus according to claim 5, wherein the second member is formed with a second opening which communicates with the first opening of the first member, and has an area smaller than an area of the first opening.

* * * * *